US006295912B1

(12) United States Patent
Burleson et al.

(10) Patent No.: US 6,295,912 B1
(45) Date of Patent: Oct. 2, 2001

(54) POSITIVE ALIGNMENT INSERT (PAI) WITH IMBEDDED EXPLOSIVE

(75) Inventors: John D. Burleson, Denton; Joseph A. Henke, Lewisville; Duc B. Nguyen, Arlington; James M. Barker, Mansfield, all of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/315,692

(22) Filed: May 20, 1999

(51) Int. Cl.[7] ..... C06C 5/06
(52) U.S. Cl. ..... 89/1.15; 102/275.7; 102/275.12
(58) Field of Search ..... 89/1.15; 102/275.2, 102/275.3, 275.4, 275.6, 275.11, 275.12, 202.14, 217, 275.7

(56) References Cited

U.S. PATENT DOCUMENTS

| | | | | |
|---|---|---|---|---|
| 2,535,518 | * | 12/1950 | Rich | 102/275.4 |
| 4,383,484 | * | 5/1983 | Morrey | 102/275.3 |
| 4,615,271 | * | 10/1986 | Hutchinson | 102/275.4 |
| 5,009,163 | * | 4/1991 | Robins et al. | 102/275.5 |
| 5,123,356 | * | 6/1992 | Brooks et al. | 102/275.12 |

* cited by examiner

*Primary Examiner*—Stephen M. Johnson

(74) *Attorney, Agent, or Firm*—William Imwalle; David W. Carstens

(57) ABSTRACT

Redundant explosive transfer between two explosive carrier devices is accomplished by inserting into a transfer sub or gun head a non-moveable explosive means for receiving the detonating cord which, at its first end, establishes a gap from an adjacent positive alignment insert (PAI) and wherein the length of explosive means is sufficient to assure detonation between the explosive means and the detonating cord in the event that the detonating cord shrinks due to the temperature of well applications. In the preferred embodiment of the present invention, a positive alignment insert consists of an aluminum insert housing having an annular region of imbedded explosive. The annular region of the explosive-filled insert is typically annularly lined with an aluminum sleeve for protecting the explosive within and maintaining an annular region of sufficient diameter to allow for the passage and placement of the detonating cord and booster. A positive alignment insert is inserted into both the crossover pin-and-box and the grooved tandem, or into similar transfer subs, or into gun head adapters. A stop is provided in the crossover sub, which maintains the minimum gap required to transfer a high order detonation from the explosive in the first positive alignment insert to the explosive in the second positive alignment insert. Thus, when positive alignment inserts are used within a transfer sub, the original gap between bi-directional boosters is not as critical because detonation will propagate from one detonating cord to the next by propagating through the explosive within the first positive alignment insert to the explosive in the second positive alignment insert.

9 Claims, 6 Drawing Sheets

POSITIVE ALIGNMENT INSERT (PAI) WITH IMBEDDED EXPLOSIVE

BACKGROUND OF THE INVENTION

1. Technical Field

The present invention relates generally to perforating a well bore with a plurality of perforating guns. More specifically, the present invention relates to an improved apparatus for transferring the detonating reaction from one gun to the next gun without interruptions.

2. Description of the Related Art

Well bore or down hole perforating guns can be conveyed into a well bore in one of two methods—first by using a wireline for conveying the perforating gun, including slickline (conductorless wireline); and second, by using tubing for conveying the perforating gun. In the wireline conveyance method, a hollow carrier gun is attached to the wireline by means of a perforating head. A wireline is a cable which contains at least one electrical conductor. The gun is lowered into the well bore and aligned across the geologic zone of interest and electrically detonated from the surface. Wireline perforating is generally limited to combinations of guns totaling 30 or 40 feet in length due to the weight of the guns on the wireline.

The second conveyance method is by tubing conveying perforating (TCP) guns. Conveying perforating guns into a well bore using tubing generally requires a much longer time for descent to the geologic zone of interest. Once at the zone of interest, the guns are again aligned and detonated. Detonation is initiated either by percussion (i.e., by dropping a bar or weight through the tubing striking the detonation head of the perforating gun); pressure (i.e., by increasing the hydrostatic pressure within the tubing until it reaches a predetermined pressure on the perforation head, at which time a shear pin is broken and the perforating gun is detonated); or electrically (i.e., by lowering a wireline through the tubing which connects to the perforating head of the gun and detonating the perforating gun by passing an electrical current through the wireline to the perforating head).

There are two primary advantages of tubing conveying perforating guns over wireline conveying perforating guns. First, the length of the guns in the tubing conveying method can be much longer because tubing supports a much higher gun weight than wireline. Second, the well bore need not be vertical but might, instead, be highly deviated or even horizontal; and the tubing conveying perforating guns can still be deployed across the geologic zone of interest.

Wireline conveying perforating guns, on the other hand, have the advantage of reduced trip time in and out of the well bore. For instance, a thin geologic zone of interest which requires one run or trip in the well bore, where the well bore is substantially vertical, takes much less trip time than using tubing as a conveyance. A wireline conveying perforating gun can be lowered into the well bore, the casing perforated, and the spent perforating gun retrieved out of the well bore in less time than it would take to lower the tubing conveying perforating gun. As opposed to using wireline, it takes much longer to run lengths of tubing into the well bore by connecting one tubing stand or joint at a time and positioning detonating the tubing conveying perforating gun either hydraulically, mechanically or electrically.

However, because the maximum perforating gun weight for tubing is much higher than for wireline, one trip into the well bore using tubing might yield a perforated interval equivalent to many wireline trips into the well bore. Also, perforating horizontal and highly deviated wells may require tubing as a means to move the perforating gun because the perforating gun will no longer fall with gravity due to the amount of deviation in the well bore.

Generally, temperature increases with well depth, and well bore temperatures of 400° F. to 450° F. are not uncommon. The explosive components of a perforating gun are particularly susceptible to the effects of high temperatures in well bores. At temperatures above the rating of a particular explosive component, detonation results become unpredictable. A high order detonation (i.e., one in which the explosive reacts at an extremely rapid rate, generating a simultaneous pressure wave) is necessary for an explosive charge to perforate a well bore, and it is less likely in cases where the well bore temperature exceeds the temperature rating of the explosives. Another factor which reduces the likelihood of a high order detonation is the amount of time the explosive is exposed to certain temperatures. Explosives are rated by time limit and maximum temperature. Generally, the higher the temperature, the less time the explosive can tolerate that temperature and still predictably detonate at high order. FIG. 1 illustrates a typical time/temperature chart for explosives used in perforating guns. 2,6-bis(Picrylamino)-3,5-dinitropyridine (PYX), hexanitrostilbene (HNS), cyclotetrimethylenetetrinitramine (HMX), and cyclotrimethylenetrinitramine (RDX) are common explosives used in the oil well perforating industry. Note from operating curve 10, that PYX is rated at 450° F. for 1000 hours, but the time at 550° F. drops to 10 hours. The time/temperature operating curves for PYX 10, HNS 20, HMX 30 and RDX 40 are roughly parallel through different operational temperatures.

FIG. 2 illustrates the components in a typical perforating gun system. A conventional perforating gun consists of three explosive components. The first, used at the initiating stage, is the blasting cap or detonator (not shown). Detonators can be either electric or percussion. The blasting cap initiates the detonation that is transferred through detonating cord 102 (second component) to individual shape charges 104 (third component). The detonating cord may be run from one end of the gun to the other and provides an explosive shock wave of sufficient force to detonate each shape charge. Shape charges are usually oriented perpendicular from the axial line of the gun. The detonator cord runs behind each shape charge and triggers a small primer charge (not shown) in each individual shape charge 104 when detonated.

In instances where the interval to be perforated is longer than any one perforating gun length, perforating guns must be combined in order to obtain the proper length. In wireline operations, each gun can be configured with its own blasting cap and fired sequentially from the bottom up. However, there are instances in which two perforating guns are detonated simultaneously. Two guns, top or upper perforating gun 106 and bottom or lower perforating gun 108 can be joined with a gun head adapter or transfer sub which consists of two short, threaded stubs of steel crossover pin-and-box 110 and grooved tandem 120. Detonating cord 102 fastens through crossover pin-and-box 110 and grooved tandem 120, passing from the upper perforating gun 106 to the lower perforating gun 108. Detonating cord 102 is usually separated at the makeup point between crossover pin-and-box 110 and grooved tandem 120. Thus, the length of the gun can be divided into two smaller guns, upper perforating gun 106 and lower perforating gun 108, and re-combined at the well site by inserting grooved tandem 120 into crossover pin-and-box 110. The detonation, therefore, must propagate from detonating cord 102 in upper perforating gun 106 to detonating cord 102 in lower perforating gun 108.

In order to facilitate the propagation of the detonation from upper perforating gun 106 to lower perforating gun 108, or visa versa, each end of detonating cord 102 is usually terminated with a bi-directional booster at both crossover pin-and-box 110 and grooved tandem 120. Upper bi-directional booster 116 is positioned by upper booster sleeve 126 in upper gun 106 and lower bi-directional booster 118 is positioned by lower booster sleeve 128 in lower gun 108. A bi-directional booster provides an extra boost of explosive force, propelling the explosive shock wave from the first booster toward the second booster, which then reinitiates the detonating cord on the second booster's side of the transfer sub. Simultaneous detonation of multiple perforating guns is more popular with TCP.

In TCP applications, each gun is usually brought to the well with a fixed number of individual shape charges 104, or shots; and detonating cord 102 at the connecting point between each upper gun 106 and lower gun 108 is terminated with bi-directional boosters 116 and 118, respectively, inserted inside grooved tandem 120 into crossover pin-and-box 110. The distance or gap between bi-directional booster 116 and bi-directional booster 118 is critical. When the guns are fully joined, the distance between the two bi-directional boosters should be approximately one-quarter of an inch. However, at the time when the individual guns are loaded, either at the shop or at the well site, the booster gap is approximately one-eighth of an inch from the face of either crossover pin-and-box 110 or the face of grooved tandem 120. When grooved tandem 120 is screwed into crossover pin-and-box 110, upper booster 116 is approximately one-fourth of an inch from lower booster 118. Thus, the booster gap is approximately one-fourth of an inch. At the time the detonating cord is detonated, the detonation force easily propagates across the one-fourth of an inch gap between the two transfer subs.

As discussed above with respect to FIG. 1, explosives are rated by the time and temperature at which they are considered reliable. For instance, PYX explosive has a temperature-time rating of 450° F. for 1000 hours, while HMX has a temperature-time rating of 400° F. for one hour. Time-temperature rating is an extremely important consideration when choosing which explosive to use in a particular perforating application. For example, a well bore is known to be 400° F. at the geologic zone of interest. Assuming trip time would be over two hours to convey the perforating guns to the geologic zone of interest, align the guns across the geologic zone of interest and detonate the guns, an explosive with a temperature-time rating of 450° F. for one hour, (such as HMX), would be an inappropriate choice. For this well bore, the time required to perforate at the down hole temperature would take the explosive over its temperature rating. Therefore, the most appropriate explosive for this well would be one with a higher temperature-time rating than the temperature known to exist in the well, such as HNS or PYX.

A problem associated with perforating high temperature wells is that of detonating cord shrinkage. The detonating cord may shrink substantially in length even while exposed only to times and temperatures below the rating of the explosive. Shrinkage or pull-back causes the boosters to be pulled back from each other and, thus, widens the gap between them. This situation leads to unpredictable detonation force transfer between perforating guns. Another problem attributed to shrinkage is that the explosive within the detonating cord is pulled back from the explosive within the bi-directional booster. The results are similar because the detonation force is not transferred to the booster from the detonating cord.

SUMMARY OF THE INVENTION

The present invention consists of a method and apparatus for successfully propagating a high order detonation from one detonating cord to a second detonating cord in a well perforating operation. The method and apparatus consist of inserting into a transfer sub or gun head a non-moveable explosive means for receiving the detonating cord which, at its first end, establishes a gap from an adjacent positive alignment insert (PAI) wherein the length of explosive means is sufficient to assure detonation between the explosive means and the detonating cord in the event the detonating cord shrinks due to the temperature of the well application. In the preferred embodiment, a positive alignment insert consists of an aluminum insert housing having an annular region of imbedded explosive. The annular region of the explosive-filled insert is typically annularly lined with an aluminum sleeve to protect the explosive within and maintain an annular region of diameter sufficient to allow passage and placement of the detonating cord and booster. A positive alignment insert is inserted into both the crossover pin-and-box and the grooved tandem, or into similar transfer subs, or into gun head adapters. A stop is provided in the crossover sub, which maintains the minimum gap required to transfer a high order detonation from the explosive in the first positive alignment insert to the explosive in the second positive alignment insert. Thus, when positive alignment inserts are used within a transfer sub, the original gap between bi-directional boosters is not as critical because detonation propagates from one detonating cord to the next by propagating through the explosive within the first positive alignment insert to the explosive within the second positive alignment insert.

BRIEF DESCRIPTION OF THE DRAWINGS

A more complete understanding of the method and apparatus of the present invention may be had by reference to the following detailed description when taken in conjunction with the accompanying drawings, wherein.

DETAILED DESCRIPTION OF THE DRAWINGS

Figure 3A:
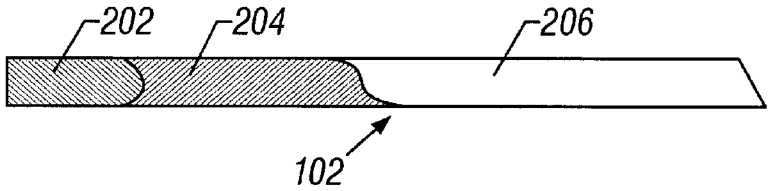
FIG. 3A depicts a cut-away view of a typical detonating cord.
Figure 3B:
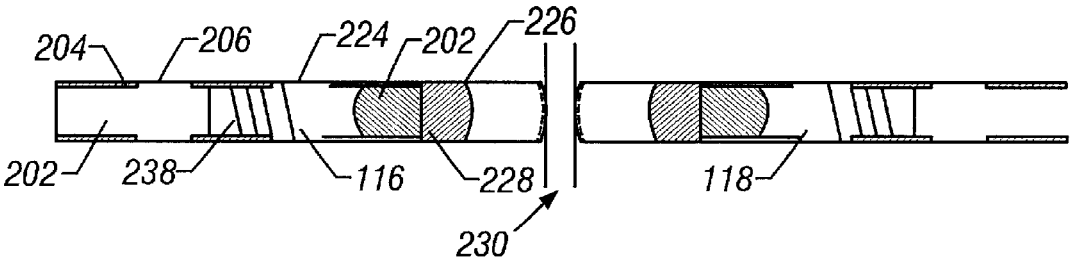
FIG. 3B illustrates upper bi-directional booster 116 and lower bi-directional booster 118 as they might appear positioned within crossover pin-and-box 110 and grooved tandem 120, respectively.
Figure 3C:
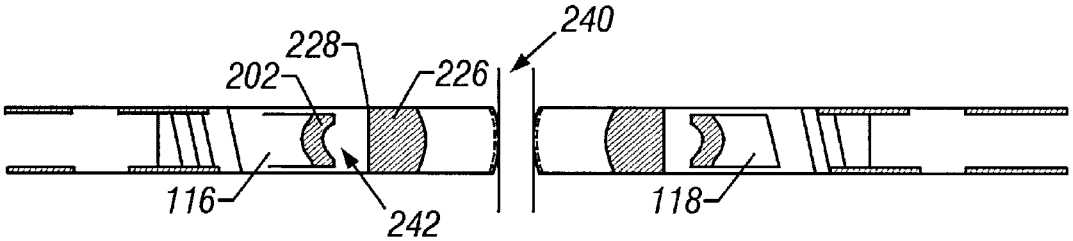
FIG. 3C illustrates a bi-directional booster configuration of two boosters in a transfer sub, identical to that illustrated in FIG. 3B but after exposure to high well bore temperatures.

FIGS. 3A–3C illustrate cut-away views of a detonating cord and aligned bi-directional boosters including a detonating cord. FIG. 3A depicts a cut-away view of typical detonating cord 102. Detonating cord 102 consists of detonating cord explosive 202 for well perforating, which may be any type of explosive listed in Table I; braided shield 204, containing detonating cord explosive 202, consisting of any one of polyester and rayon weave or a Kevlar® and Nomex® blend; and outer detonating cord jacket 206, made of plastic.

FIG. 3B illustrates upper bi-directional booster 116 and lower bi-directional booster 118 as they might appear within crossover pin-and-box 110 and grooved tandem 120, respectively. Each bi-directional booster 116 consists of an outer booster case 224, which is made of a light metal, such as aluminum; and bi-directional booster explosive 226. Usually, explosive 226 is the same explosive used in the detonating cord but in a larger quantity due to the slightly larger diameter and somewhat higher packing density of the booster. Bi-directional booster 116 is crimped onto detonating cord 102 using a hand-held crimping tool which mechanically fastens bi-directional booster 116 to detonating cord 102 by pressing outer booster case 224 into detonating cord 102 in a series of crimping striations 238. Crimping a bi-directional booster onto a detonating cord requires, first, cleanly cutting the detonating cord, usually with a razor blade, and then inserting detonating cord 102 into the open end of outer booster case 224, forming booster detonating cord interface 228 where detonating cord explosive 202 abuts bi-directional booster explosive 226. The creation of booster detonating cord interface 228 is critical to the successful initiation of the booster.

Booster detonating cord interface 228 is intended to be just that-an interface, not a gap. However, gaps resulting from improperly crimping the booster can be tolerated between detonating cord explosive 202 and bi-directional booster explosive 226 up to about one-sixteenth of an inch. Therefore, if at the time booster 116 is being crimped to detonating cord 102 and booster detonating cord interface 228, a gap of up to one-sixteenth of an inch exists, detonation will still generally propagate reliably from detonating cord 102 through booster 116.

Several problems can occur with this system of gun configuration other than improper crimping of a bi-directional booster. For instance, if at the time the gun is being loaded, the length of detonating cord 102 is not carefully considered, booster gap 230 between upper bi-directional booster 116 and lower bi-directional booster 118 can exceed the nominal one-eighth-inch gap tolerance. Nonetheless, because the density of booster explosive 226 within each bi-directional booster is greater than that within detonating cord 102, it is acceptable for booster gap 230 to exceed one-quarter of an inch. In fact, successful detonation propagation between the first gun and the second gun can be expected even when booster gap 230 measures one-half of an inch.

Another problem associated with perforating high temperature wells is the problem of detonating cord shrinkage. FIG. 3C illustrates a bi-directional booster configuration of two boosters in a transfer sub, identical to that illustrated in FIG. 3B but after exposure to well bore temperatures. The most noticeable difference between FIG. 3B and FIG. 3C is the expansion of interface 228 into interface gap 242. A much larger gap is now apparent between booster explosive 226 and detonating cord explosive 202, as illustrated by interface gap 242. Also illustrated in FIG. 3C is a larger booster gap that is shrinkage-induced-expanded gap 240. As well temperature increases, detonating cord 102 shrinks.

Detonating cord 102 consists of detonating cord explosive 202, braided shield 204, and outer detonating cord jacket 206. This particular configuration has been problematic at high temperatures because, while outer booster case 224 may be crimped securely, via booster detonating cord interface 228, to outer detonating cord jacket 206, braided shield 204 may shrink within detonating cord 102, causing detonating cord explosive 202 to pull back from bi-directional booster explosive 226 as shown in FIG. 3C. Therefore, even though a booster detonating cord interface 228 was initially created with no gap, after exposure to high temperature, interface gap 242 is created. This problem is exacerbated when the gun loader does not properly abut detonating cord explosive 202 against booster explosive 226 at the time bi-directional booster 116 is crimped.

Another problem with the configuration described in FIG. 3C is that bi-directional boosters may pull away from each other within the transfer sub, causing a larger booster gap-expanded gap 240. Just as booster detonating cord interface 228 may exceed the critical distance necessary to maintain propagation of a high order detonation, expanded gap 240 may also exceed the distance tolerance within which a high order detonation can propagate from upper booster 116 to lower booster 118. In such an instance, the second booster might not detonate or might detonate at low order, which will not propagate the required detonating shock to initiate the individual shape charges.

The problem of detonating cord shrinkage seems to be most pronounced in braided shield 204. While the length of detonating cord 102 shrinks with temperature, the shrinkage is most apparent in braided shield 204. Shrinkage of braided shield 204 causes booster detonating cord interface 228 to expand into interface gap 242 and, simultaneously, causes expanded gap 240 to replace booster gap 230. While booster gap 230 and expanded gap 240 (FIGS. 3B and 3C, respectively) appear to be approximately equal in distance in the figures, expanded gap 240 is intended to appear larger than booster gap 230.

Shrinkage rates vary with temperature and from product to product. For instance, a nylon jacket over polyester and rayon braid, such as that used in some RDX detonating cords, shrinks six percent in length when exposed to 325° F. for an hour. Therefore, detonating cord pull-back on each end of a twenty foot gun might exceed seven inches; thus, expanded gap 240 would exceed fourteen inches. In practice, however, slack in the detonating cord feed through the shape charges, as well as tension created by the placement of the detonating cord behind the shape charges, diminishes the pull-back effect somewhat.

In another example, a nylon over Kevlar® and Nomex® braid, such as that used in some PYX detonating cords, shrinks approximately one percent in length when exposed to 325° F. for an hour. Therefore, detonating cord pull-back on each end of a twenty foot gun might exceed one inch; thus, expanded gap 240 would exceed two inches, which is wider than the one-inch tolerance necessary to ensure a high order detonation between perforating guns.

Figure 4:
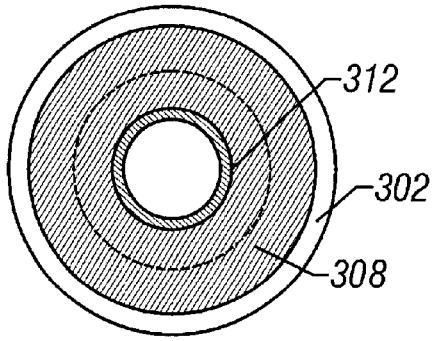
FIG. 4 illustrates a preferred embodiment of the positive alignment insert.
Figure 4:
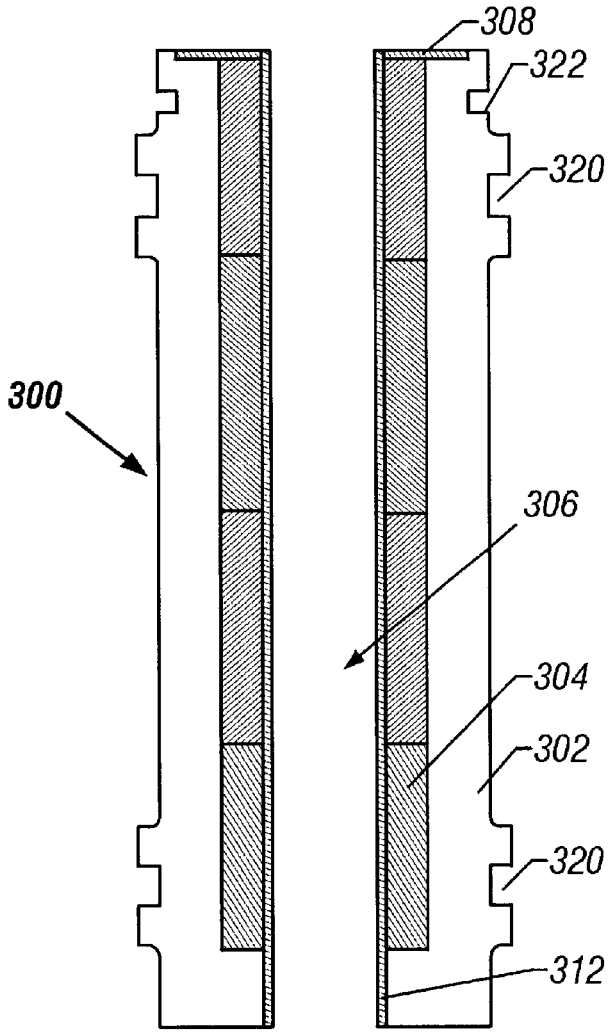

FIG. 4 illustrates a preferred embodiment of the present invention. Positive alignment insert (PAI) 300 is an insert which can be fitted into any of a variety of gun head adapter and transfer sub configurations. The system of implementing positive alignment insert 300 consists of positioning two positive alignment tools, one at each terminating end of the detonating cord in the adapters of upper gun 106 and lower gun 108. Positive alignment insert 300 consists of insert housing 302, which contains interior annular space for receiving imbedded explosive 304. Insert housing 302 is designed to be friction-fit into a transfer sub adapter by o-rings affixed in o-ring grooves 320. In a preferred embodiment of the present invention, imbedded explosive 304 is positioned in the interior annular space within insert housing 302. In another preferred embodiment, imbedded explosive 304 consists of lengthwise strips of explosive material positioned at radial intervals within the annular cavity of insert housing 302. In either case, imbedded explosive 304 is positioned such that a detonating cord positioned within interior path 306 will maintain the necessary gap tolerance for high order detonation between the detonating cord and imbedded explosive 304.

Positive alignment insert 300 further comprises inner aluminum sleeve 312 for protecting imbedded explosive 304 from the detonating cord as it is pulled through interior path 306. Aluminum washer 308, which is seated within insert housing 302 and inner aluminum sleeve 312, holds imbedded explosive 304 within the interior cavity formed by insert housing 302 and inner aluminum sleeve 312. Aluminum washer 308 also mechanically positions imbedded explosive 304 such that the gap created between positive alignment inserts in connected upper gun 106 and lower gun 108 remains within the tolerance required for a high order detonation. PAI 300 also includes insertion tool groove 322, used for inserting and recovering PAI 300 from within the transfer sub.

Figure 5:
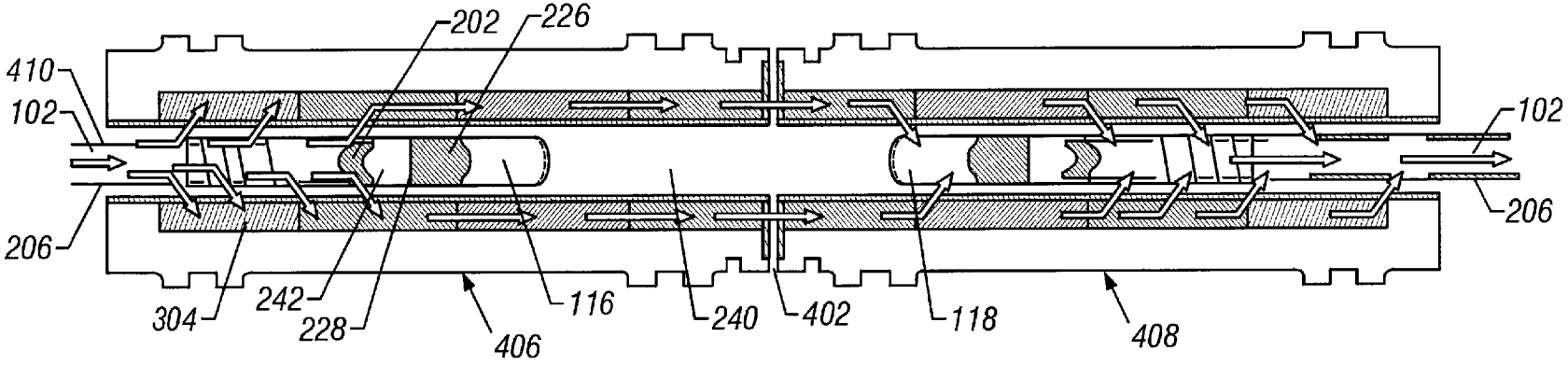
FIG. 5 depicts a pair of PAIs with imbedded explosive as would be positioned within a perforating gun system.

FIG. 5 depicts a pair of PAIs as would be positioned within a perforating gun system. Upper PAI 406 and lower PAI 408 are positioned within crossover pin-and-box 110 and grooved tandem 120. Note that expanded gap 240 between upper booster 116 and lower booster 118 far exceeds the maximum one-inch distance tolerance recommended for a high order detonation. Without the PAI system, high order detonation would not propagate from upper booster 116 to lower booster 118 because propagation force 410 (depicted by bold arrows) could not jump expanded gap 240.

FIG. 5 further illustrates the detonation path between upper PAI 406 and lower PAI 408 in upper gun 106 and lower gun 108. Booster detonating cord interface 228, which was initially created with no gap, has now expanded into interface gap 242 as a result of exposure to high temperature. Detonating cord explosive 202 has pulled back from booster explosive 226. In this example, outer detonating cord jacket 206, upper booster 116 and lower booster 118 are surrounded by, or at least proximate to, imbedded explosive 304 in both upper PAI 406 and lower PAI 408. The imbedded explosive within upper PAI 406 maintains the correct distance tolerance for propagating a high order detonation force from detonating cord 102 and imbedded explosive 304. Therefore, the detonating force will be transferred from detonating cord 102 to imbedded explosive 304 within upper PAI 406 immediately upon entering the PAI. The imbedded explosive within upper PAI 406 and lower PAI 408 maintains the correct distance tolerance between the PAI's for propagating a high order detonation force from one gun to the next.

In FIG. 5, detonation occurs from left to right and follows propagation force 410. Once the perforating gun has been lowered into place and the decision is made to detonate the gun across the interval, the blasting cap is detonated. The detonation is then transferred to detonating cord 102 and propagates through the upper gun, top to bottom. The detonation may also proceed from the bottom to the top of the lower gun (not shown). The detonating force from detonating cord 102 proceeds in a longitudinal path along the detonating cord, away from the detonation source and radially outward.

Note carefully that, in using a PAI system, propagation from one gun to the next does not longitudinally or axially transfer from upper booster 116 to lower booster 118 across expanded gap 240. Instead, the propagation force is transferred radially outward from the outer side wall of the detonating cord or bi-directional booster, or both, to the inner wall of inner sleeve 312 and into adjacent imbedded explosive 304.

Returning to FIG. 5, the propagation path follows propagation force 410. From upper PAI 406, the path flows directly from detonating cord 102 to imbedded explosive 304. From that point, the propagation proceeds through the imbedded explosive of upper PAI 406. Note that propagation force 410 jumps from detonating cord 102 to imbedded explosive 304 along the entire path where detonating cord 102 and imbedded explosive 304 are proximate. Note also that propagation ends at interface gap 242. Regardless of where propagation ends within upper booster 116, the propagation force travels within imbedded explosive 304 until reaching PAI gap 402. PAI gap 402 is preset by the mechanical configuration of aluminum washer 308 with respect to imbedded explosive 304. The propagation force proceeds, traversing PAI gap 402, into the imbedded explosive in lower PAI 408. The propagation force travels both longitudinally and radially inward toward the bi-directional booster and detonating cord within lower PAI 408. As indicated by propagation force 410, the detonation force traverses the gap among the imbedded explosive and the bi-directional booster and the detonating cord along the entire path where the detonating cord and imbedded explosive are proximate, and it continues into the lower perforating gun (not shown).

In an alternate embodiment of the present invention, detonating cord 102 is terminated with a butt end cap (not shown) rather than a bi-directional booster. In high temperature applications where pull-back is expected to create a large interface gap and a large expanded gap, high order detonation of the bi-directional booster is unlikely because of the interface gap. Problems occur when the pull-back is severe enough to enlarge expanded gap 240 to the point that detonating cord explosive 202 is no longer proximate to imbedded explosive 304. Even though booster explosive 226 remains proximate to imbedded explosive 304, interface gap 242 precludes propagation to booster explosive 226. The end result is that the propagation force is not transferred to the imbedded explosive because the propagation force ends at the end of the detonating cord, which has been pulled-back from within the PAI. Thus, in applications where propagation transfer between the detonating cord and bi-directional booster is doubtful, the effects of pull-back can be reduced by length equal to the distance from interface 228 to the cap end of booster case 224 by eliminating the booster and capping the detonating cord.

Figure 1:
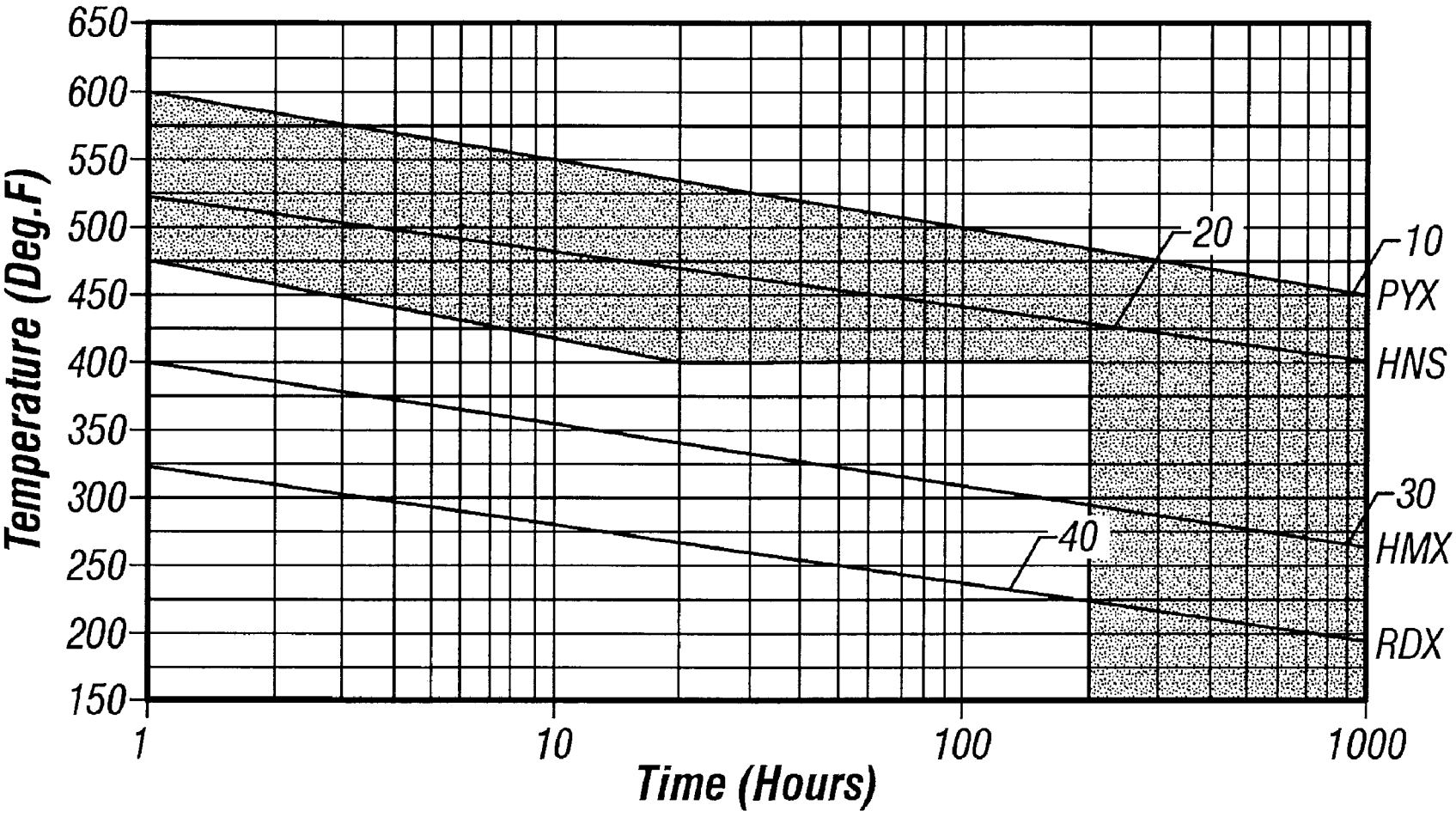
FIG. 1 is a table showing the temperature stability of various explosives.
Figure 2:
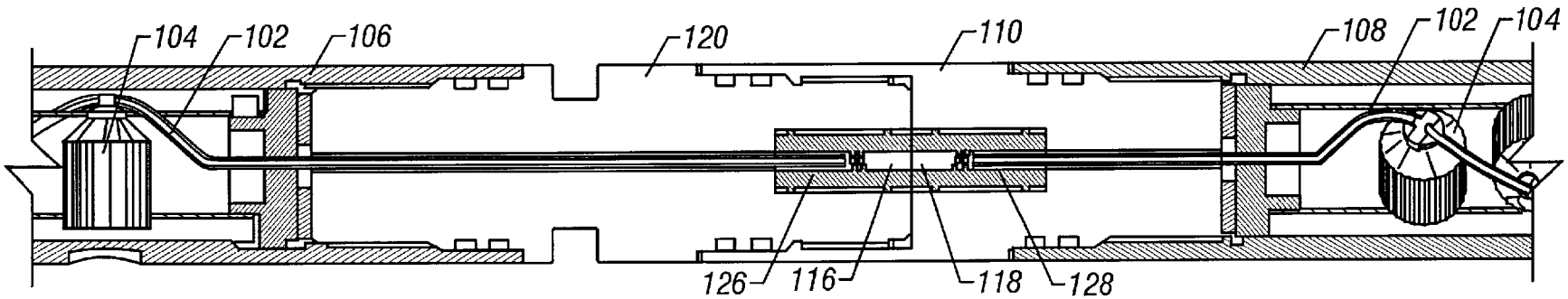
FIG. 2 illustrates the components in a typical perforating gun system.
Figure 6:
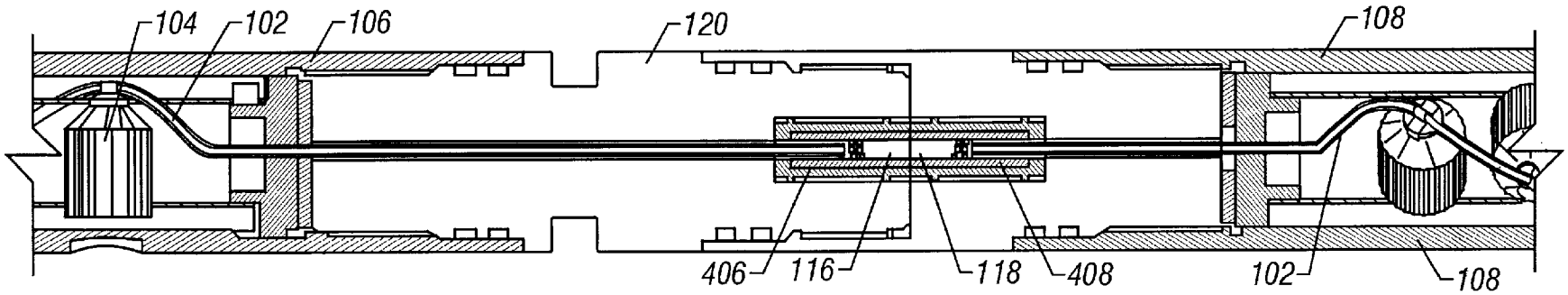
FIG. 6 depicts a PAI with imbedded explosive systems in place within the connection between two perforating guns similar to those depicted in FIG. 2.

FIG. 6 depicts a PAI system in place within a transfer sub between two perforating guns, similar to the system depicted in FIG. 2. The detonation force transfers along detonating cord 102 to individual shape charges 104 in upper gun 106 and into lower gun 108 through crossover pin-and-box 110 and grooved tandem 120. Upper bi-directional booster 116 is positioned by upper PAI 406 in upper gun 106, and lower bi-directional booster 118 is positioned by lower PAI 408 in lower gun 108.

Figure 7A:
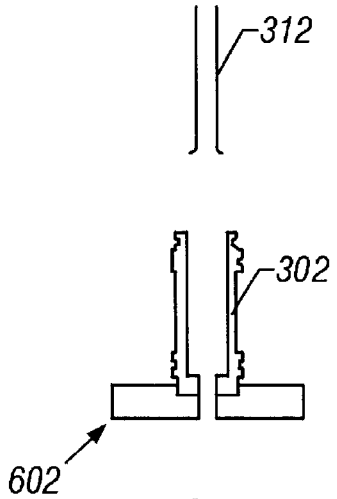
FIGS. 7A–7F illustrate the manufacturing process for producing a positive alignment insert with imbedded explosive, as in a preferred embodiment of the present invention.
Figure 7B:
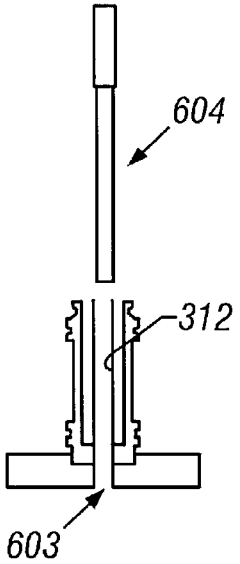
Figure 7C:
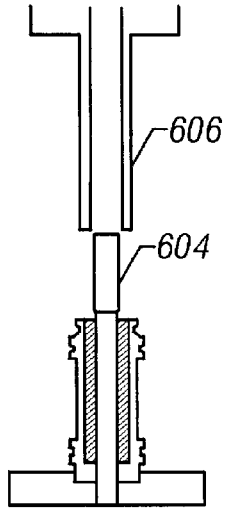
Figure 7D:
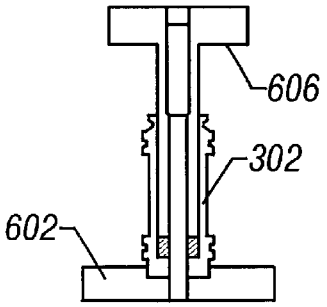
Figure 7E:
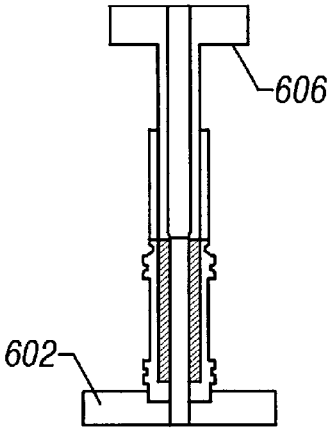
Figure 7F:
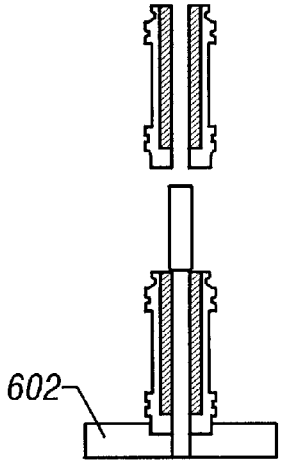

FIGS. 7A–7F illustrate the manufacturing process for producing a positive alignment insert with imbedded explosive as in a preferred embodiment of the present invention. A preferred method of manufacturing positive alignment insert 300 is by securely mounting insert housing 302 to workbench 602 (or another immovable structure). FIG. 7A depicts insertion of inner aluminum sleeve 312 into the center of the annular cavity within insert housing 302. FIG. 7B illustrates insertion of nonferrous (brass) mandrel 604 through inner aluminum sleeve 312 into orifice 603 in workbench 602. Insertion of mandrel 604 seats inner sleeve 312 in insert housing 302 and provides support for the subsequent manufacturing steps. FIG. 7C illustrates use of annular setting tool 606. On the initial pass, annular setting tool 606 gauges the annular recess between aluminum sleeve 312 and insert housing 302, in preparation for imbedding explosives. FIG. 7D illustrates the first explosive imbedding pass, wherein annular setting tool 606 is used to imbed a small amount of explosive—approximately 4 grams of relatively sensitive high temperature explosive such as trinitrotripicryl benzene (BRX), hexanitrostilbene (HNS-1 or HNS-4), or nonanitroterphenyl (NONA). FIG. 7E illustrates subsequent passes with annular setting tool 606, wherein additional amounts of explosive are imbedded in stages, approximately 1.5 grams of PYX or HNS per stage. Three stages of PYX or HNS complete the imbedding. In a final stage, annular setting tool 606 seats washer 308 in insert housing 302 around inner sleeve 312. FIG. 7F illustrates the finished PAI being removed from brass mandrel 604 and workbench 602.

Although preferred embodiments of the present invention have been described in the foregoing Detailed Description and illustrated in the accompanying drawings, it is to be understood that the invention is not limited to the embodiments disclosed but is capable of numerous rearrangements, modifications, and substitutions of steps without departing from the spirit of the invention. Accordingly, the present invention is intended to encompass such rearrangements, modifications, and substitutions of steps as may fall within the scope of the appended claims.

What is claimed is:

1. A system for positive transfer of detonation force between explosives mounted in explosive carriers, the system comprising:

(a) first and second positive alignment inserts, each comprising:

(i) an insert housing having a first and second end, the first end adapted to receive a segment of detonating cord, the second end adapted to transfer a detonation force; and (ii) an explosive, the explosive being imbedded along a portion of a length of the insert housing between the first and second end of the insert housing;

(b) a first segment of detonating cord received into the first end of the housing of the first insert;

(c) a second segment of detonating cord received into the first end of the housing of the second insert; and (d) first and second explosive carriers, each adapted to receiving a positive aligmnent insert and aligning the respective insert's second end so as to enable a positive transfer of detonating force from the first segment of detonating cord to the second segment of detonating cord.

2. The system for positive transfer of detonation force as recited in claim 1, wherein the portion and the length of the explosive in the first and second positive alignment inserts is sufficient for positive transfer of detonating force with respect to the first and second segments of detonating cord, as the first and second segments of detonating cord shrink and provide a redundant explosive transfer between the first and second explosive carriers.

3. The system for positive transfer of detonation force as recited in claim 1, wherein the portion and the length of the explosive in the first and second positive alignment inserts is sufficient for positive transfer of detonating force to the respective first and second segments of detonating cord.

4. A positive alignment insert with imbedded explosive comprising:

(a) a first movable detonation means;

(b) a first positive alignment explosive means for receiving a detonation force at variable alignments from the first movable detonation means and for directing the detonation force to a fixed position;

(c) a second movable detonation means;

(d) a second positive alignment explosive means for receiving a detonation force at variable alignments from the second movable detonation means and for directing the detonation force to a fixed position; and (e) a connecting means, wherein the connecting means provides a physical connection between the first positive alignment explosive means and second positive alignment explosive means and provides an alternate detonation path from the first movable detonation means to the second movable detonation means.

5. A method for assuring positive transfer of detonation force between explosives mounted in explosive carriers, the method comprising:

providing a first detonating means;

providing a second detonating means;

providing a first positive alignment explosive means;

providing a second positive alignment explosive means;

slidably positioning the first detonating means proximate to the first positive alignment explosive means, wherein the first detonating means and the first positive alignment explosive means remain proximate in a plurality of positions of the first detonating means;

slidably positioning the second detonating means proximate to the second positive alignment explosive means, wherein the second detonating means and the second positive alignment explosive means remain proximate in a plurality of positions of the second detonating means;

connecting the first positive alignment explosive means to the second positive alignment explosive means, wherein the first and second positive alignment explosive means provide a detonating path between the first detonating means and the second detonating means.

6. An apparatus for assuring positive transfer of detonation force between explosives mounted in explosive carriers, comprising:

(a) a first positive alignment explosive means;

(b) a second positive alignment explosive means (c) a first detonating means slidably positioned proximate to the first positive alignment explosive means, wherein the first detonating means and the first positive alignment explosive means remain proximate in a plurality of positions of the first detonating means;

(d) a second detonating means slidably positioned proximate to the second positive alignment explosive means, wherein the second detonating means and the second positive alignment explosive means remain proximate in a plurality of positions of the second detonating means; and (e) a connecting means between the first positive alignment explosive means and the second positive alignment explosive means, wherein the first and second positive alignment explosive means provide a detonating path between the first detonating means and the second detonating means.

7. A system for positive transfer of detonation force, comprising:

(a) a first movable detonation means;

(b) a first positive alignment explosive means adapted to receiving a detonation force at variable alignments from the first movable detonation means and directing the detonation force to a fixed position;

(c) a second movable detonation means;

(d) a second positive alignment explosive means adapted to receiving a detonation force at a fixed position and directing the detonation force to the second movable detonation means at variable alignments; and (e) a connecting means between the first positive alignment explosive means and the second positive alignment explosive means, wherein an alternate detonation path from the first movable detonation means to the second movable detonation means is provided.

8. The system for positive transfer of detonation force of claim 7, further comprising:

(f) a first explosive carrier adapted to fixably hold the first positive alignment explosive means; and (g) a second explosive carrier adapted to fixably hold the second positive alignment means.

9. The system for positive transfer of detonation force of claim 8, wherein the connecting means includes means for physically connecting the first explosive carrier to the second explosive carrier.

* * * * *